US007721392B2

(12) United States Patent
Avery

(10) Patent No.: US 7,721,392 B2
(45) Date of Patent: May 25, 2010

(54) PORTABLE SECUREMENT SYSTEM

(76) Inventor: Michael Scott Avery, 12940 Calais Cir., Palm Beach Gardens, FL (US) 33410

( * ) Notice: Subject to any disclaimer, the term of this patent is extended or adjusted under 35 U.S.C. 154(b) by 617 days.

(21) Appl. No.: 11/524,886

(22) Filed: Sep. 22, 2006

(65) Prior Publication Data

US 2007/0062011 A1 Mar. 22, 2007

(51) Int. Cl.
*A45F 5/00* (2006.01)

(52) U.S. Cl. ..... 24/3.12; 24/3.1; 24/303; 24/552

(58) Field of Classification Search ..... 24/3.1, 24/11 R, 11 FE, 11 HC, 11 C, 3.3, 3.11, 3.12, 24/303, 66.1, 551–554, 598.6
See application file for complete search history.

(56) References Cited

U.S. PATENT DOCUMENTS

| | | | | | |
|---|---|---|---|---|---|
| 2,152,897 | A | * | 4/1939 | Madore | 24/303 |
| 2,641,793 | A | | 6/1953 | Wilm | |
| 2,644,212 | A | | 7/1953 | Markowitz | |
| 2,964,812 | A | | 12/1960 | Cook | |
| 3,159,372 | A | | 12/1964 | McIntosh | |
| 3,178,784 | A | | 4/1965 | Krauthamer | |
| 1,416,195 | A | | 12/1968 | Borthwick | |
| 4,157,166 | A | | 6/1979 | Voelker | |
| 4,325,504 | A | | 4/1982 | Amani | |
| 5,084,943 | A | * | 2/1992 | DeCanio | 24/3.12 |
| 5,278,591 | A | | 1/1994 | Trotter | |
| 5,366,070 | A | | 11/1994 | Wolov | |
| 5,654,787 | A | | 8/1997 | Barison | |
| 5,687,458 | A | * | 11/1997 | Coker | 24/336 |
| 5,699,990 | A | | 12/1997 | Seach | |
| 5,732,451 | A | | 3/1998 | Mars | |
| 3,845,369 | A | | 12/1998 | Dunchock | |
| 5,842,613 | A | | 12/1998 | White | |
| 5,895,018 | A | | 4/1999 | Rielo | |
| 5,979,021 | A | * | 11/1999 | Swift | 24/66.6 |
| 6,039,173 | A | | 3/2000 | Crow | |
| 6,168,273 | B1 | | 1/2001 | Dupraz et al. | |
| 6,282,760 | B1 | | 9/2001 | Mars | |
| 6,367,126 | B1 | | 4/2002 | Rivkin | |
| 6,375,324 | B2 | | 4/2002 | Schleger et al. | |
| 6,568,805 | B1 | | 5/2003 | Dietz | |
| 6,904,710 | B2 | | 6/2005 | Lawrence et al. | |
| 7,229,171 | B2 | | 6/2007 | Dietz | |
| 7,496,991 | B2 | * | 3/2009 | Avery | 24/3.3 |
| 2007/0245528 | A2 | | 10/2007 | Vermillion | |

* cited by examiner

*Primary Examiner*—James R Brittain
(74) *Attorney, Agent, or Firm*—Donald Grant Kelly

(57) ABSTRACT

A portable securement system for securing implements such as eyewear and pens to a user's garment for safekeeping. The system includes a device usually hidden in use, and formed as a pendant construction to be mounted on button threads behind a garment placard. There it is anchored while a magnet secured at the device's lower part secures implements for easy retrieval. The device includes an opening which may be placed over the button, with a narrowed portion of the opening engaging the threads and serving as an anchoring trap to hold the device in place. In an alternative arrangement, wire-like segments define the device's central opening and terminate at opposed wire ends at an upper part of the device to form a releasable clip. This clip may be utilized to anchor the device to an inner seam or other garment parts where it can be utilized without being outwardly visible.

1 Claim, 3 Drawing Sheets

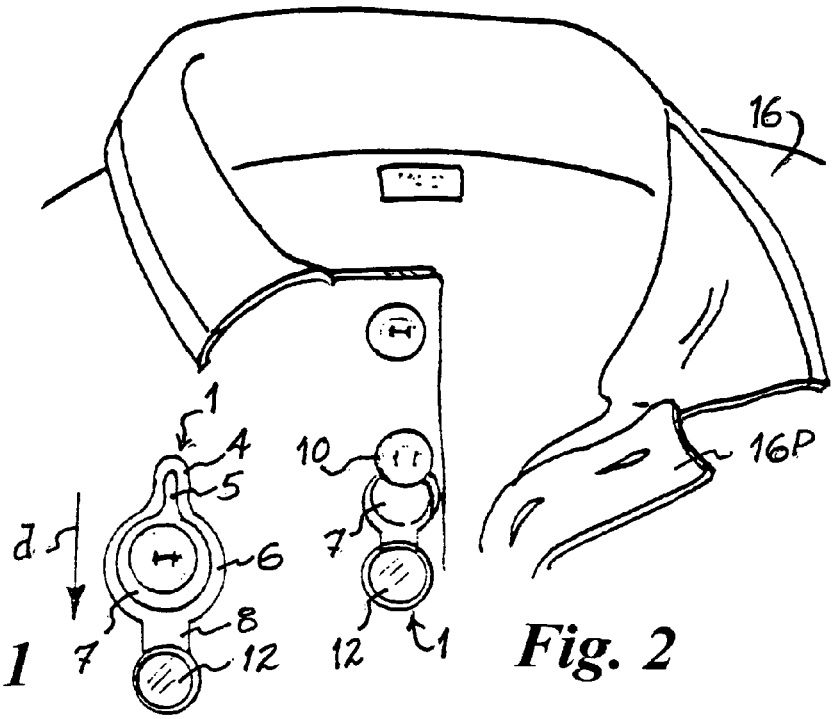
Fig. 1
Fig. 2
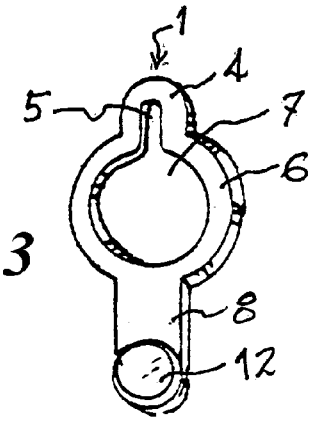
Fig. 3
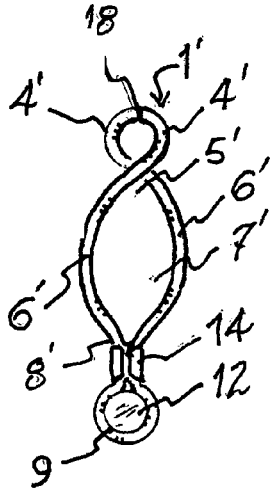
Fig. 4
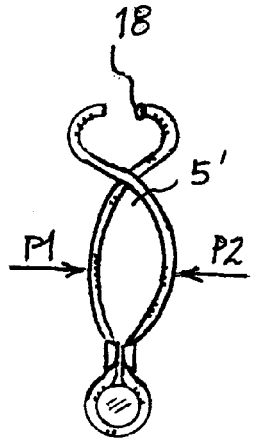
Fig. 5

PORTABLE SECUREMENT SYSTEM

REFERENCE TO RELATED APPLICATIONS

This application is related to U.S. patent application Ser. No. 11/524882, concurrently filed on Sep. 22, 2006 by the same inventor, and issued on Mar. 3, 2009 as U.S. Pat. No. 7,496,991.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. Field of the Invention

This invention relates to the field of supports and holders for implements, particularly magnetic elements facilitating temporarily securement of personal items to a garment base or the like for storage, safekeeping and easy access as needed.

2. Description of Related Art

Various alternatives currently exist for transporting and keeping a user's personal implements (such as eyewear and pens) on her/his person, so that they are readily available when needed. One of the most common methods of transport is the use of the shirt or pants pocket, but the implements tend to fall out or become bent as will be described below. A flexible open-ended case or pocket protector, sometimes equipped with a pocket clip, is widely used to overcome this problem. Hinged cases that are fully closed for storage often are not satisfactory either.

For example, eyeglass cases, pen cases and the like are generally bulky and unflattering when carried in a pocket. Besides, materials employed in fabrication of such cases, typically leather or vinyl; do not permit adequate air flow when stored in a pocket, resulting in a user's undesirable heat retention and perspiration. More often than not, the user will choose to avoid a storage case altogether and instead insert pens and unprotected eyeglasses directly into a pocket, if a pocket is available.

A majority of sport shirts, tee shirts, aprons and blouses do not include pockets. The option of carrying a pen or pair of glasses in a pocket associated with the trousers too frequently results in ink-stained fabric or abrasions to the eyeglass lenses imparted by loose change, keys and the like. In addition, eyewear frames too often are subjected to bending or breaking when the user stoops or sits.

The same can be said when a pens and eyewear are carried unprotected and commingled in a purse, handbag or briefcase. Hard-shell, hinged cases are available for protection, but are bulky and demand a significant amount of space. Wearing a pair of eyeglasses tethered or otherwise attached to retainers such as straps, chains or the commonly known "croakies" does offer convenience, but may also be perceived as an annoyance or tacky. As an example, attention is directed to Barison's U.S. Pat. No. 5,654,787 showing a portable securement device in the form of eyeglasses temple mounted clips which appear to slide over the ends of the temples.

Over the years, magnets have been employed as portable securement devices to hold jewelry, pins or brooches on garments. For example, Borthwick's U.S. Pat. No. 1,416,195 shows an early use of a magnet to secure a corsage in place without damaging garment fabric. Unfortunately, securement parts are subject to being lost.

More recently the U.S. Pat. No. 6,282,760 issued to Mars shows a brooch having a magnet embedded therein so as to be held against clothing by internally mounted magnetic element. Another patent issued to Mars, U.S. Pat. No. 5,732,451, describes a jewelry holder for non-invasive attachment to a garment where paired magnets grip fabric therebetween so as to hold the jewelry in place. One magnet of the pair includes a passage for a jewelry pin serving to hold the jewelry thereto. Here, too, parts may be easily displaced or lost.

Items such as pencils and pens also have been altered or equipped so as to render them securable through the use of magnets. Krauthamer's U.S. Pat. No. 3,178,784 teaches a portable magnetic securement system mounted on a pencil and attached to removable base in the form of a sheet metal strip mounted on clothing pocket. Mcintosh's U.S. Pat. No. 3,159,372 presents another magnetic pencil holder where the magnetic element has a slot for pencils and the like and attaches, for example, to a metal frame of a table. These ancillary devices are obtrusive and unattractive.

Cook illustrates yet another portable securement device for holding a pencil on a support which is magnetically held to a base. See Cook's U.S. Pat. No. 2,964,812. A portable securement system in the form of a sleeve mounted on a pencil is taught by Markowitz (U.S. Pat. No. 2,644,212), where the sleeve includes a magnet embedded therein and a cooperative magnet holder element clips to a garment. Cook's device also is obtrusive and unattractive.

Rielo's U.S. Pat. No. 5,895,018 shows a holder for magnetically supporting lightweight articles of thin pliable material (such as kitchen towels) to a magnetic surface. Rielo employs a pair of magnet-holding fastening plates attached so as to retain the pliable material therebetween for subsequent placement against the magnetic surface. Similarly, Wiln's U.S. Pat. No. 2,641,793 presents a potholder with an embedded magnet for temporary storage on metal support. Rielo and Wiln either damage or severely alter the articles to which their devices are applied.

A number of patented devices addresses the need for safely and conveniently storing eyeglasses (as well as other items) when not in use. For instance, the patent granted to Lawrence et al., U.S. Pat. No. 6,904,710, discloses apparatus for securing an object to a support utilizing magnetic elements. As an example, Lawrence et al. show a pair of spectacles including a magnet disc secured by a narrow flexible loop to a temple of the spectacles. The prominent and highly visible magnet disc of Lawrence et al. is shown altered to include decorative indicia or image on its outer surface. The user may temporarily store the folded spectacles by placing them on ferrous, magnetic surfaces such as a refrigerator door. There is no attempt to make the securement system subtle or blended into the spectacle temple.

Dietz, in U.S. Pat. No. 6,568,805, depicts magnetic elements affixed at the midpoints of eyeglasses temple bars such that the magnetic elements are aligned when folded or closed for storage. When folded together, the magnets are attracted to each other and form a clamp to temporarily secure folded eyeglasses temples onto clothing fabric. The magnetic elements are secured to the temple bars in a variety of ways. Their constant magnetic attraction when folded may be found to be annoying to the user and less than satisfactory. Dietz offers little more than the widespread method of hanging the eyeglasses temple bar in a pocket or shirt button placard.

Schleger et al. illustrates eyeglasses temple bars with tips that incorporate magnet elements as presented in U.S. Pat.

No. 6,375,324. These magnet elements, rather than relating to temporary storage or holding of the eyeglasses when not being born, are for health-related treatment and are equally spaced bio-magnets providing a magnetic field to the wearer's head. There appears to be no mention of eyeglasses storage as far as Applicant can discern.

Another eyewear holder is taught by Rivkin, U.S. Pat. No. 6,367,126, wherein two magnets are affixed outside the fabric of a wearer's clothing. These two magnets are held in place by a magnetically saturable keeper plate just inside the fabric. A bridge connection extended between the magnets forms a loop through which eyeglasses temple bar may be inserted for temporary storage. This device is decidedly bulky and obtrusive.

In the disclosure of Dupraz et al., U.S. Pat. No. 6,168,237, an apparatus is described for facilitating temporary storage of eyeglasses on a non-ferrous base. At least one magnetic element is associated with the eyeglasses frame by gluing, screwing, crimping or the like. For example, the magnetic element can be forced into a hole (e.g., a through-hole or blind-hole) provided in any of the components of the frame. When it is desirable to store eyeglasses to a support base of non-ferrous material such as a fabric garment, aluminum bicycle frame or car dashboard, a magnetic keeper base may be provided. Ferrous metal (magnetically attracted material) and magnet components may be reversed in application as desired. The holding devices of Dupraz et al. are prominent and obtrusive, and the fabric mount is invasively damaging.

U.S. Pat. No. 6,039,173 issued to Crow presents another method of temporarily supporting eyeglasses when not in use. Crow's holder may be fixed, as by taping, to a storage point such as a computer monitor or vehicle dashboard. The holder includes a conduit into which a free end one temple bar or stem may be inserted for securement. Crow's device is purposely obtrusive and would not readily adapt to use with garments.

U.S. Pat. No. 3,845,369 granted to Dunchock presents a holder in the form of a pin structure mounted on clothing fabric and including a loop through which an eyeglasses temple bar may be inserted for temporary storage. White's U.S. Pat. No. 5,842,613 illustrates and describes a holder for eyeglasses wherein the holder is to be positioned in a garment pocket. Dunchock's device is invasive and fabric damaging.

U.S. Pat. No. 5,699,990 issued to Seach presents a mounting base for temporarily holding eyeglasses wherein the base includes a space accommodating an eyeglasses temple stem. Wolov, in U.S. Pat. No. 5,366,070, illustrates a device for securing a pen to a pen securement area utilizing hook and loop fasteners.

The U.S. Pat. No. 5,278,591 issued to Trotter shows a spectacle temple stem holder clip for securement of the spectacles within a pocket. Trotter's accessory kit further includes a tether line to permit remote mounting of the eyeglasses as well as a fiber optic cable to direct illumination forwardly of Trotter's eyeglasses framework. Amani's U.S. Pat. No. 4,325,504 presents a tubular sleeve for a user's wrist, wherein the sleeve is formed to include a magnet for retaining magnetically holds ferrous elements in wrist-mounted container U.S. Pat. No. 4,157,166 issued to Voelker presents another obtrusive eyewear holder having a hole for encircling a rear-view mirror post on an automobile. The holder further includes a pair of holes permitting insertion therethrough of the temple piece of an eyeglasses frame. In lieu of the hole for encircling a mirror post, an alternative embodiment includes a magnet for securing the holder to a magnetic base.

With general reference to the prior art as discussed hereabove, it is apparent that a market exists for an innovative securement system that would serve to safely and conveniently store items such as eyewear, pens, pencils and so forth, and do so in a dependable, non-invasive, aesthetic and unobtrusive manner. The prior art, while trying to solve this problem, fails for a variety of reasons.

Prior art devices are seen in many cases as inappropriate for portable personal use and non-adaptable for use in association with clothing. Those that are adapted to personal portability are obtrusive and unfashionable in appearance or deleterious to garment fabric when utilized. Further, it is important that the system be portable and easily put into use as required. Moreover, it is crucial that use of securement system avoid adverse impact on fabrics with which it may be associated or utilized.

The problem takes on new dimensions with an aging demographic, particularly with respect to vast population growth among people with increasing need for reading glasses. What is needed is a simple, easy to use securement system or docking device that can employ the recently developed high-strength magnet devices for storing implements such as eyewear, pens and so forth directly to a garment for ready access. The system should be fashionably subtle, yet consistently dependable. The securement system should be essentially invisible to the casual observer.

It will become apparent from reading the present disclosure that Applicant's novel invention resolves the disadvantages inherent with pre-existing alternatives and methodologies. The present invention further affords greater convenience and economy of motion. With the use of the inventive portable securement system to be described, the simple act of depositing implements such as pens or a pair of glasses on one's clothing (or other convenient location) takes less effort than stowing them away or setting them down in the first place.

BRIEF SUMMARY OF THE INVENTION

A principal objective of the present invention is to provide a portable securement system for temporarily or indefinitely retaining or securing implements such as eyewear or pens (or other personal items for that matter) on a users' garments or the like in such a way as to have a non-invasive or damaging impact on the garments themselves.

In the present context, eyewear is a term used to refer to eyeglasses, spectacles, sunglasses, bifocals, sunshade clip-on, and the like. The portable securement system described herein may, in fact, have application to any of a wide variety of personal items requiring temporary securement relative to a non-magnetic substrate, such as fabric of a garment, so as to be safe and handy when needed. However, without intent to limit the scope of the disclosure or claims presented below, the present invention disclosure will maintain primary focus on temporary securement of eyewear and pens to garment substrates.

The portable securement system device for temporary, portable securement is adapted to receive implements such as eyewear or pens having (or provided with) magnetic properties so as to attach the implements to a nonferrous surface such as a shirt, blouse, or other garment. This will render the secured items readily available on demand. A distinct advantage in the design of the present docking device is that the application and function thereof avoids having to use or apply epoxy, solder, weld, adhesive tape, molding or gluing techniques, screws, pins, bolts or other conventional fasteners which would have abusive, invasive or otherwise damaging impact on the garment and/or the implements to be docked thereon (e.g., eyewear or pen).

A non-invasive or non-damaging portable securement system device is presented as a pendant construction. In the present context, the term pendant is considered to mean: something suspended from something else (*The American Heritage® Dictionary of the English Language*, Fourth Edition). The inventive device includes an upper attachment part for anchoring to a garment, and a generally downwardly depending or suspended lower part to which is affixed a magnet. The portable securement system device is herein disclosed in its two related embodiments with minor variations therebetween. A first embodiment of the pendant construction includes an open loop defined by lateral sides, said loop having a relatively narrow upper opening interconnected to a relatively wider central opening.

The narrower upper opening serves as a detent or trap configured to non-invasively engage garment button threads for anchoring the securement device against movement relative to the garment. Affixed to the lower part of the pendant construction is a relatively powerful magnet to which magnetic implements may be temporarily held.

Similar to the first embodiment just described, a second docking device component is formed as a pendant construction to include an upper attachment or anchoring part from which is suspended a lower part. In this instance, the parts are fabricated from a wirelike material (which is defined as including wire and wirelike material that may be similarly deformed, hereafter referred to simply as "wire") of a predetermined, finite length. The wire is deformed to create a magnet-holding area at the lower docking device part and a central loop at the upper attachment part defined by flexibly opposed wire sides.

The loop has a narrower upper to optionally serve as a detent essentially identical to the function of the first docking device embodiment. More significantly, the wire terminates at two opposed ends at their upper extremity, thereby forming a spring biased clip operable by pressing the opposed wire sides.

Thus, opposing wire ends of the second docking device embodiment act as an expansible clip or grabber. Finger pressure on opposing wire sides provides sufficient force to spread apart the wire/wire-like segment's upper ends. This separation results in the opposing wire ends forming a clip or grabbing area to be directly clipped to garment parts (particularly internal parts of the garment fabric such as seams or internal pleats), or placed around button threads as noted above.

Upon release of pressure, a spring-like memory characteristic of the wire permits biased movement of the opposing wire ends into engagement with the garment part or parts. Thus, the docking may be attached at a point on or within a garment and suspend generally downward from said point, supporting the magnet at its lower part.

Magnets utilized in the present inventive system may, for example, comprise neodymium, also called a neo magnet with more detail to follow herebelow, and might further include what is commonly known in the magnet technological field as a magnet booster for more demanding performance (i.e., securing heavier items).

These relatively small magnets could be connected to their associated securement devices and eyewear temples only through magnetic attraction, depending on the nature of the material from which the securement system device is fabricated. When a flexible tube encompasses a magnetic disc and serves to hold it against a temple stem, there generally is no need for further connection means.

Alternatively, these magnets may be affixed or mechanically connected in place through metallic or epoxy bonding, mechanical wrapping, mechanical fasteners, gluing, welding, crimping or other suitable, equivalent fastening techniques. In some instances, as exemplified in the prior art discussion hereabove, an implement (e.g., eyewear and/or pen) to be temporarily secured may not itself possess magnetic properties, but can be altered to include magnets in an assortment of ways.

BRIEF DESCRIPTION OF THE DRAWINGS

The invention will be best understood by reference to the following detailed description of an illustrative embodiment when read in conjunction with the accompanying drawings, wherein:

FIG. 1 illustrates a plan view of a first portable securement device shown in position to be slid down onto a garment button for temporary attachment thereto;

FIG. 2 shows a front perspective of a garment (e.g., shirt or blouse) having attached thereto a portable securement device repositioned downwardly so as to temporarily, connectively engage a button of said garment;

FIG. 3 shows a front perspective of the first portable securement docking device detailed for clarity;

FIG. 4 illustrates a plan view of a second embodiment of portable securement docking device presented in closed position for removably, connectively engaging a button or other garment element;

FIG. 5 illustrates a plan view of the second embodiment presented in open or unclamped position;

DETAILED DESCRIPTION OF THE INVENTION

Figure 6:
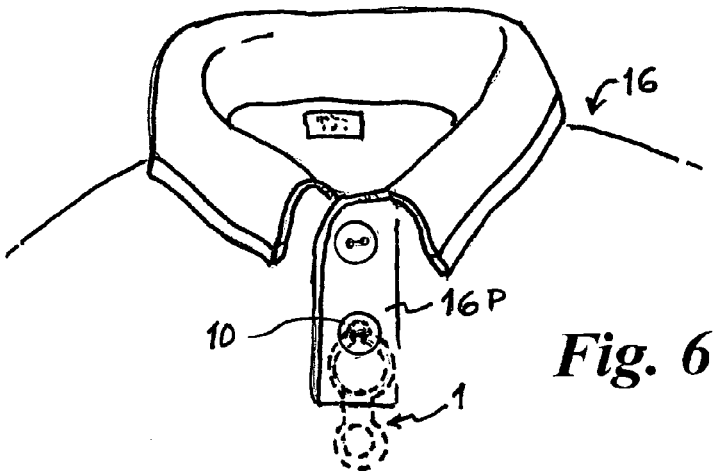
FIG. 6 is a front perspective illustrating a garment on which is temporarily affixed a first embodiment of portable securement docking device obscured by a garment placard as indicated by phantom lines.

Details of the present invention are provided for purpose of illustration and disclosure, but are not intended as exhaustive or limited to the invention in the form disclosed. Many modifications and variations of the inventive device will be apparent to those of ordinary skill in the art.

Personal implements, particularly eyewear or pens generally required by users to be easily accessible as needed, may be docked or temporarily secured through use of the novel portable securement system presented and described herein. This inventive system is especially unique in the manner in which it can be anchored to a users garment such as a shirt, sweater, dress or the like.

FIG. 1 shows a first embodiment of a portable securement system device 1 in the form of a pendant construction. Device 1 includes a first or upper part 4 with sides 6 and lower part 8. This device 1 may be molded, machined, stamped or otherwise manufactured of any suitable material (metal, plastic, natural substance, and the like or a combination thereof). Sides 6 are fabricated or shaped so as to define a generally central loop or opening 7 of a predetermined dimension adequately sized to accommodate being placed over a typical garment button 10 as viewed in FIG. 2. Typical garment buttons may range in size from around one-fourth inch up to as much as one inch in diameter; however, most are in the range of three-eight inch to one-half inch in diameter.

A first or upper part 4 of said portable securement device 1, as more clearly demonstrated by FIG. 3, is fabricated or shaped so as to define a first or upper channel opening 5 as a generally upward extension of opening 7 and characterized as having a predetermined dimension. The predetermined dimension of said upper opening 5 is seen as distinctly narrower than the predetermined dimension of said central opening 7.

When said portable securement system device 1 is placed against a garment 16 (see FIG. 2) such that the central opening 7 surrounds button 10 and lowered in direction d, the threads securing button 10 to garment 16 are confined in the narrower opening 5 which thus serves as an anchor trap or detent anchoring the pendant construction of said securement system device 1 against movement relative to garment 16.

A relatively small magnet 12 is attached to the third or suspended lower part 8 of portable securement system device 1 and is thus suspended generally below the threads of button 10. Attachment of magnet 12 may be accomplished through magnetic attraction (depending on the magnetic nature of the material from which lower part 8 is fabricated). Alternatively, such attachment may be accomplished by epoxy or metal bonding, mechanical wrapping, mechanical fasteners, gluing, welding, crimping or equivalent fastening technique.

Figure 7:
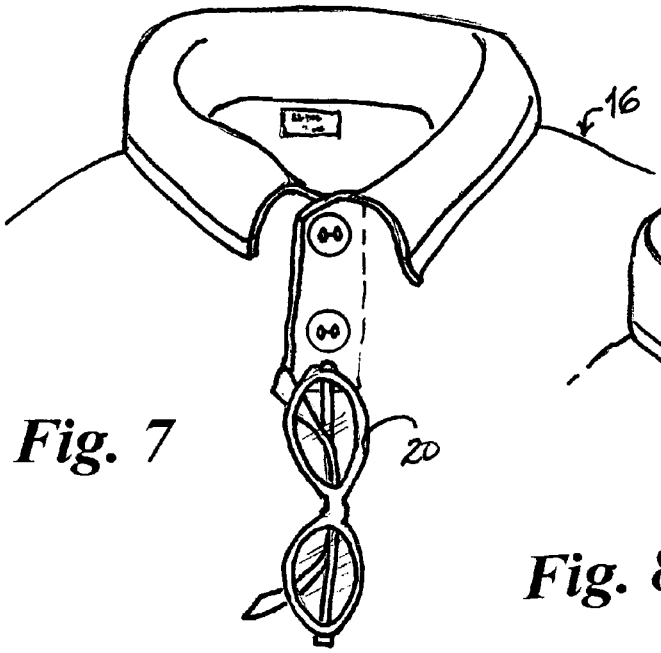
FIG. 7 illustrates a front perspective view of eyewear secured in place by a first embodiment of portable securement docking device in accordance with the present invention, where the portable securement system device is concealed behind a garment button placard.
Figure 8:
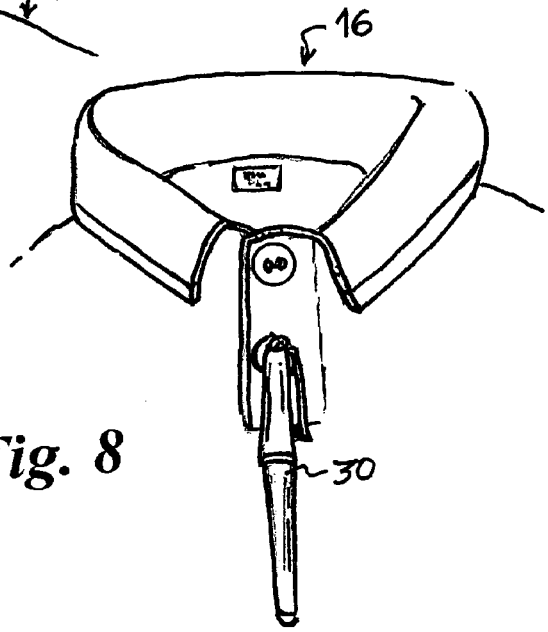
FIG. 8 is a front perspective illustrating a fountain pen supported by a docking device in accordance with the present invention, where the first embodiment of securement system docking device is concealed behind a garment button placard.

As noted, the weight of magnet 12 acts to pull the upper part 4 and opening 5 defined therein generally downwardly and into anchoring engagement with button 10. When the placard 16*p* of garment 16 is closed into buttoning position as shown in FIG. 6 the portable securement system device 1 (indicated by phantom lines) is hidden from view. This affords a uniquely neat appearance with the portable securement system clearly unobtrusive and without invasive, damaging impact to the garment 16 fabric. FIGS. 7 and 8 respectively illustrate eyewear 20 and pen 30 secured on docking device component 1 hidden behind garment 16 placard 16*p*.

A user, with a single direct motion, may place metallic eyewear 20 or pen 30 directly against (or merely near) hidden securement system device 1. When juxtaposed to magnet 12, such items are immediately drawn into place for temporary securement. When needed, a slight, purposeful tug on a docked item will remove it from securement. Unlike so many prior art devices, no damages are imparted to the fabric and magnetic securement elements are not misplaced loosely within the garment. Next to be described is a similarly functioning alternative or second embodiment of the present invention.

Depicted in FIGS. 4 and 5 and FIGS. 9-11 is the second embodiment of portable securement system docking device (designated 1') also of a pendant construction. Portable securement system device 1' may be fabricated from a durable material that is spring-like (i.e., the material can be flexed or bent, yet possesses mechanical memory force when deformed so as to recover its pre-flexed shape and position). For example, device 1' including said upper and lower part may be configured from a single, finite segment of metal wire with a pair of opposed ends 18. The portable securement system device 1' further includes a first or upper part 4' with sides 6', and lower part 8' as will be further explained herebelow.

The lower part 8' of the second embodiment extends downwardly from said upper part 4' and opposed sides 6' and further includes a magnet 12 affixed thereto. In the second securement system device embodiment illustrated in FIG. 5, magnet 12 is shown as held captive or mechanically gripped within bend 9 of the metal wire segment 8' and thus positioned for securing implements thereto. Of course, additional or other fastening techniques as described above may be utilized as necessary. A mechanical crimp 14 can be applied across said bend at lower part 8' to stabilize and strengthen docking device 1'. Other crimping or stabilizing equivalents may obviously be employed as well.

Opposing sides 6' of said second embodiment portable securement system device 1' define a loop or opening 7'. It will be evident from the drawings that loop 7' narrows into an upper opening area designated 5' similar to narrow opening 5 described above. So formed, this area 5' can, when required, serve as a trap or detent anchoring the device against movement relative to the garment to which it is mounted. Opposing sides 6' may be curved as shown in FIG. 4 or could be configured in the irregular polygonal shape depicted as sides 6' in FIG. 9. In either case, the opposing sides of said upper part extend above loop 7', crossing one another as shown so as to form a clip with first and second opposing segment ends 18 yieldably pressed together by force of said mechanical memory.

More specifically, wire segment sides 6' may be pressed and released such that opposing wire ends 18 are respectively opened and closed to comprise a spring-bias anchor clip. As illustrated in FIG. 5, finger pressure (P1, P2) on the opposing curved sides 6' provides sufficient force to open the gap at wire ends 18 to facilitate clipping of the portable securement docking device 1' to garment parts, particularly internal parts of the garment fabric such as a seam, hem, pleat, lining and so forth. The weight of the lower part 8' and magnet 12 keeps the docking device oriented below the upper part 4' when in use, thus keeping its hidden position predictable to the user when docking implements thereon.

Figure 9:
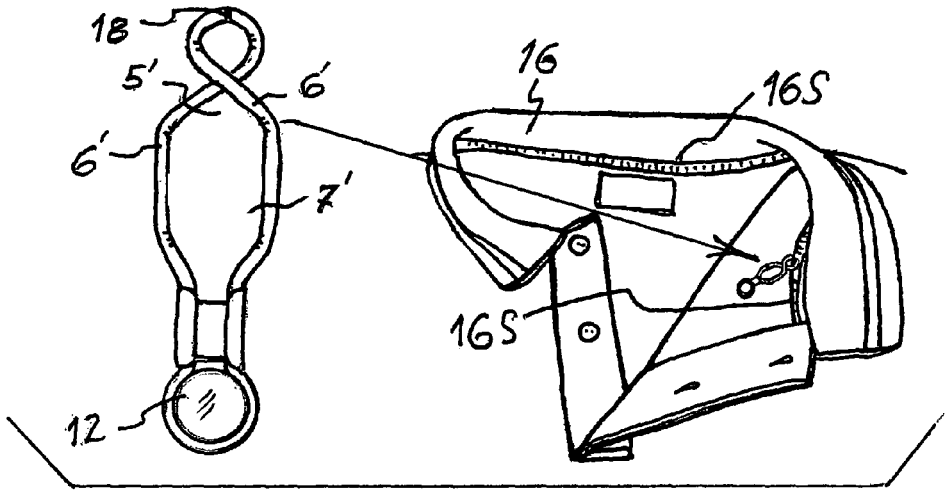
FIG. 9 is a view of the second embodiment of portable securement system illustrating the general appearance of the second embodiment and its functioning position affixed within a garment.

As demonstrated in FIG. 9, the second embodiment of portable securement device 1' is temporarily clipped to garment 16 at an inner seam 16S thereof. The device 1' is clearly shown to comprise a single, finite segment of metal wire extending continuously from a first opposed segment end (at 18) at the upper anchoring part, around magnet 12 at the lower implement securing part (at bend 9), returning to terminate at a second opposed segment end (again at 18) at the upper anchoring part.4'. Once secured, device 1' serves as a securement docking point for any magnetic element or implement including but not limited to eyewear and pens whether or not they include magnets mounted thereon.

Figure 10:
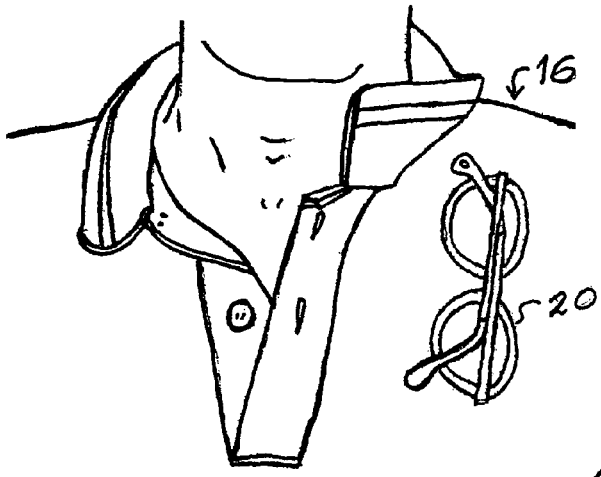
FIG. 10 is a view of eyewear held in place on a garment through attraction of the second embodiment of portable securement system affixed, but not visible, on the internal surface of the garment.
Figure 11:
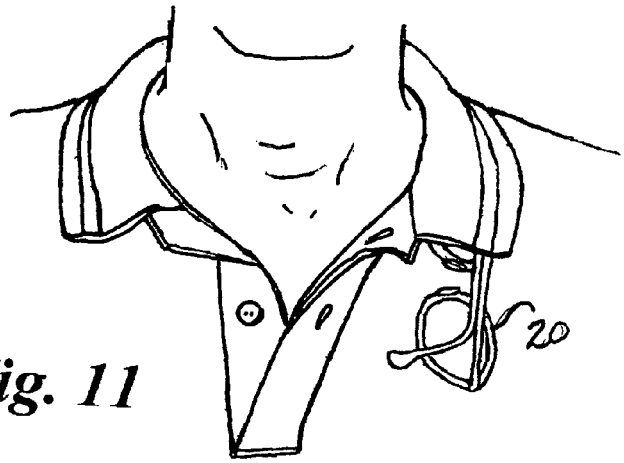
FIG. 11 is a view similar to FIG. 10, but with a collar turned downward so as to partially cover the secured eyewear.

Once the device 1' is in place, the placard may be closed and implements to be secured are simply placed at or near the hidden docking device 1' such that the magnetic attraction draws the implements into securement. Again, the implements may be retrieved as needed, and with only a slight tug from the user. By way of example, FIG. 10 illustrates eyewear 20 placed on the securement system device, and FIG. 11 shows the garment 16 collar folded to partially cover the secured eyewear.

It should be noted that the second embodiment security system device 1' is applicable to buttons in essentially the same manner described relative to the first embodiment device 1. Opening 7' as shown in FIGS. 4 and 9 includes a loop 7' permitting its placement over a button 10 (though not shown). The device 1' is then lowered so as to engage the button thread within an upper narrowed opening 5'. In yet another application, the dip formed by upper loop 4' at wire ends 18 could be secured around button threads so as to be anchored thereon.

For all practical purposes, magnets and ferrous/magnetic components described herein may be reversed in application. In other words, where an implement to be secured is itself (in whole or in part) a magnet, the magnet 12 (previously described as) attached to device 1 or 1' may be replaced by a ferrous metal element capable of attraction to said magnet implement.

Thus, the present invention can be conveniently modified as appropriate by simple replacement of the magnet 12 with a non-magnet yet "magnetic" element. The term "magnetic" is intended to convey the conventional meaning that a magnetic element may possess properties of a magnet or the capability of being attracted to a magnet.

The present invention commands a level of magnetic attraction or "pull power" typical of powerful rare-earth permanent magnet compositions. Widely known examples are neodymium-iron-boron formulations, or NdFeB. These neodymium-iron-boron formulations have been available for such applications only for the past several years, and are known to be fabricated in the shape of rods, blocks, rings, disks and cubes. By way of example only, such magnet elements may be of the neodymium-iron-boron formulation believed to be available as "NdFeB grade 35" from Forcefield Magnets, Inc.

Magnet elements 12 are illustrated herein as relatively small discs. Importantly, the present invention is not limited to any specific shape, grade, power or strength, as long as it is adequate to its task. Furthermore, when necessary, the magnetic force of the portable securement may be readily increased through the addition of a "booster" magnet that is simply magnetically applied to the existing magnet 12, and still considered within the scope of the present invention.

Although the portable securement device described above can be worn with numerous types of garments, a sport shirt (of the polo type) has been employed herein to demonstrate its intended use. This choice is in no way intended as limiting the scope of the present invention and the myriad of applications it can enjoy.

Again, there are several ways to affix the portable securement device either to the inside or outside of the garment, depending upon the user's own preference. In each case, the device or components of the present invention will be found to be relatively unobtrusive. In use it remains secure from accidental detachment and its application will impart no damage to garment fabric.

Although various embodiments have been described in the foregoing detailed description and illustrated in the accompanying drawings, it will be understood that the invention is not limited to the embodiments disclosed, but may assume numerous arrangements, rearrangements, modifications and substitutions of elements without departing from the spirit of the invention nor from the scope of the claims which follow.

I claim:

1. A portable securement docking device system for temporarily securing implements relative to a garment, said system including a pendant construction comprising:

an upper anchoring part and a suspended implement-holding lower part;

said upper and lower parts are configured from a single finite segment of metal wire;

said upper part including opposed wire lateral sides defining an opening wherein said lateral sides possess mechanical memory when deformed;

said wire segment lateral sides of said upper part extend above said opening, crossing one another so as to have first and second opposed ends thereof pressed together by force of said mechanical memory force to form a spring biased anchor clip configured to secure said docking device on a garment;

said wire lateral sides of said upper part extend below said opening to form, at said lower part, a bend within which a magnet is held captive and positioned for securing implements thereto;

said device further including a mechanical crimp applied to said wire across said bend to further secure said magnet captured therein;

whereby said portable securement docking device is strengthened and stabilized by said mechanical crimp and said upper part may be anchored to a portion of said garment while said magnet depends generally therebelow and serves to temporarily secure implements thereon for easy access.

* * * * *